US005563615A

United States Patent [19]

Tay et al.

[11] Patent Number: 5,563,615

[45] Date of Patent: Oct. 8, 1996

[54] BROADBAND END FED DIPOLE ANTENNA WITH A DOUBLE RESONANT TRANSFORMER

[75] Inventors: Yew S. Tay, Plantation; Danny O. McCoy, Sunrise; Quirino Balzano, Plantation, all of Fla.

[73] Assignee: Motorola, Inc., Schaumburg, Ill.

[21] Appl. No.: 416,542

[22] Filed: Apr. 3, 1995

Related U.S. Application Data

[63] Continuation of Ser. No. 4,048, Jan. 15, 1993, abandoned.

[51] Int. Cl.[6] ..... H01Q 9/00

[52] U.S. Cl. ..... 343/749; 343/791; 343/792

[58] Field of Search ..... 343/749, 895, 343/745, 900, 790, 791, 792; H01Q 9/00

[56] References Cited

U.S. PATENT DOCUMENTS

| | | | |
|---|---|---|---|
| 2,802,210 | 8/1957 | Berndt | 343/792 |
| 3,588,903 | 6/1971 | Hampton | 343/792 |
| 4,117,493 | 9/1978 | Altmayer | 343/720 |
| 4,137,534 | 1/1979 | Goodnight | 343/752 |
| 4,180,819 | 1/1979 | Nakano | 343/792 |
| 4,494,122 | 1/1985 | Garay et al. | 343/722 |
| 4,540,989 | 9/1985 | Day, Jr. | 343/900 |
| 4,772,895 | 9/1988 | Garay et al. | 343/895 |
| 4,829,311 | 5/1989 | Wells | 343/749 |
| 4,940,989 | 7/1990 | Austin | 343/749 |
| 5,231,412 | 7/1993 | Eberhardt et al. | 343/895 |

*Primary Examiner*—Hoanganh T. Le

*Attorney, Agent, or Firm*—M. Mansour Ghomeshi; Juliana Agon

[57] ABSTRACT

An antenna comprises a feed port, a ½ wavelength radiator (20), and a double resonant transformer (10). The feed, port, having a signal feed portion (34) and a ground portion (44), is at a low impedance while the ½ wavelength radiator (20) has opposed high impedance ends (21 and 22). For transforming low impedance to high impedance, at two resonant frequencies, the double resonant transformer is coupled between the feed port and the ½ wavelength radiator.

10 Claims, 3 Drawing Sheets

BROADBAND END FED DIPOLE ANTENNA WITH A DOUBLE RESONANT TRANSFORMER

This is a continuation of application Ser. No. 08/004,048, filed on Jan. 15, 1993 and now abandoned.

TECHNICAL FIELD

This invention relates generally to antennas, and more specifically to end-fed dipole antennas suitable to transmit or receive an information signal.

BACKGROUND

One fundamental antenna requirement for communication equipment, such as fixed or base station transceivers and mobile radios, is high radiation gain. To satisfy the gain requirement, a half-wave end-fed dipole with an impedance transformer, such as a quarterwave helix feed, is usually used as the antenna because a suitable ground plane, for a counterpoise, is provided in base stations and mobile radios. However, to cover the entire spectrum, for example, of the very high frequency (VHF) band of 136–174 MHz, four or five band splits of these dipole antennas, end fed by the quarterwave helix, tuned to different resonant frequencies, are needed. An equal number of band split antennas are necessary to cover the ultra high frequency (UHF) band of 403–512 MHz. Consequently, as factories strive to reduce inventories and unit costs, one single broadband antenna that could cover or operate across the entire band, at comparable radiation gain and size, would be very desirable and cost effective.

SUMMARY OF THE INVENTION

Briefly, according to the invention, an antenna comprises a feed port, a ½ wavelength radiator, and a double resonant transformer. The feed port, having a signal feed portion and a ground portion, is at a low impedance while the ½ wavelength radiator has opposed high impedance ends. For transforming the low impedance to high impedance, at frequencies between the two resonance, the double resonant transformer is coupled between the feed port and the ½ wavelength radiator.

In one aspect of the invention, the dipole radiator is approximately between ½ wavelength to ⅝ wavelength $\lambda_o$.

In another aspect of the invention, the double resonant transformer is a quarter wavelength $\lambda_1$ helix feed surrounded by an approximately ¼ wavelength $\lambda_2$ helix for broadbanding the dipole.

In a further aspect of the invention, the dipole radiator comprises a plurality of dipole elements separated by an 180 degree phase shifter, assembled collinearly.

DETAILED DESCRIPTION OF THE PREFERRED EMBODIMENT

Figure 1:
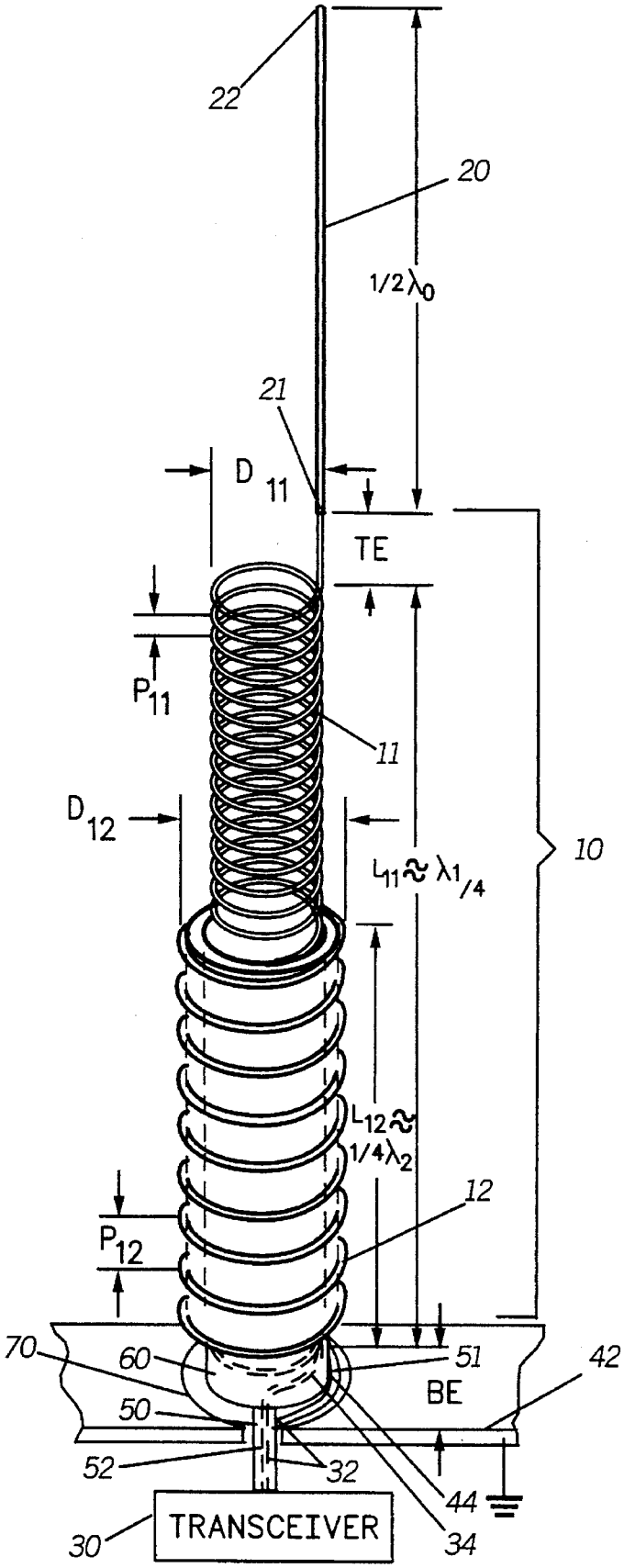
FIG. 1 is a representation of an end-fed dipole antenna in accordance with the present invention.
Figure 2:
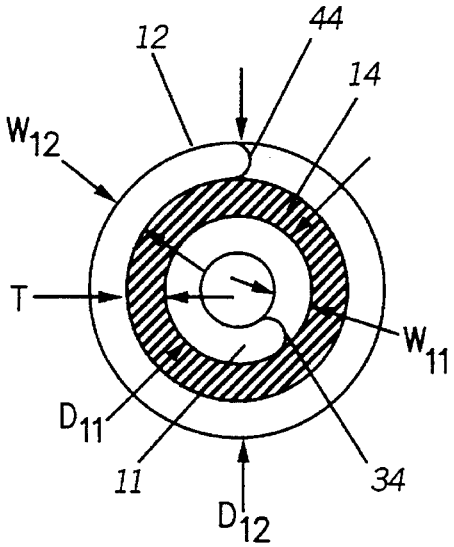
FIG. 2 is a bottom cross-sectional view of the transformer of FIG. 1.
Figure 3:
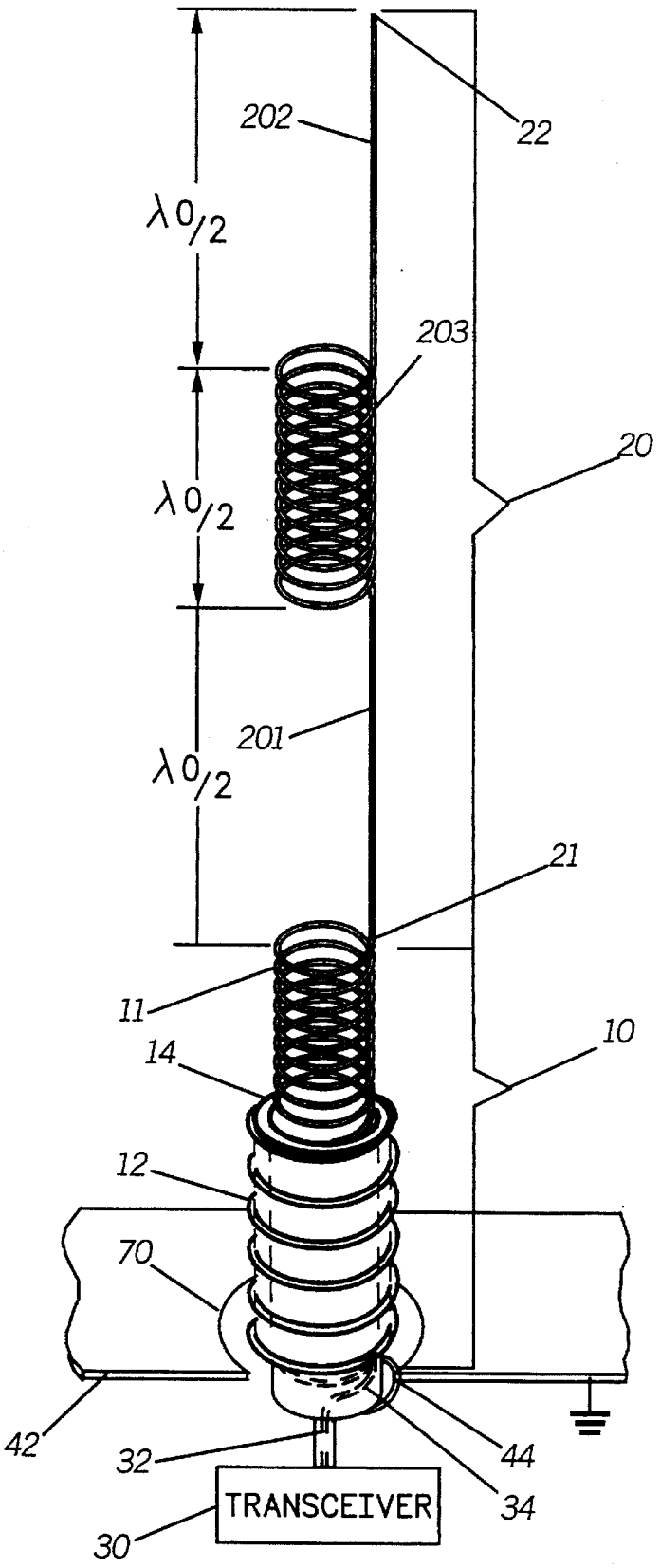
FIG. 3 is a representation of a collinear dipole array in accordance with the present invention.

Referring to FIG. 1, an antenna includes a double resonant transformer 10, properly impedance matched, double resonantly tuned at two resonances, f1 and f2, and an end-fed radiator 20, such as a single dipole element in FIG. 1 or a collinear dipole array comprised of at least two dipole elements 201 and 202, separated by an 180 degree phase shifter in the form of a halvewave helical coil 203 in FIG. 3. At least one dipole element has to exist to form the radiator 20, as shown in the form of a single straight wire radiator of FIG. 1, but the plurality of dipoles 201 and 203 can also form the radiator 20 because they can be separated by the helically wound phase shifter 203, as shown in FIG. 3. The 180 degree phase shifter 203 suppresses energy that is opposite of the desired phase from the two dipole elements 201 and 202. Apart from the form of the primary radiating element, there are no significant differences between FIG. 1 and FIG. 3. Therefore, the discussion of FIGS. 1,2, and 4 will relate also to FIG. 3.

By design, the end-fed radiator or dipole 10 has opposed first or bottom (21) and second or top (22) high impedance ends. Preferably, the electrical length of the dipole 20 is approximately a half wavelength (0.5λo wherein λo=free-space wavelength at the design frequency) for resonating at an operating, fundamental, or design center frequency fo which may be the center of the band. However, an electrical length up to approximately ⅝ wavelength could also be used as the dipole radiator. The actual lengths implemented may vary from the ideal design to compensate for real world losses, manufacturability, etc. As shown, the dipole radiator 20 is arranged perpendicular to a ground plane 42. Thus, the radiator 20 is a dipole with two opposed high impedance ends, at its fundamental frequency.

Figure 4:
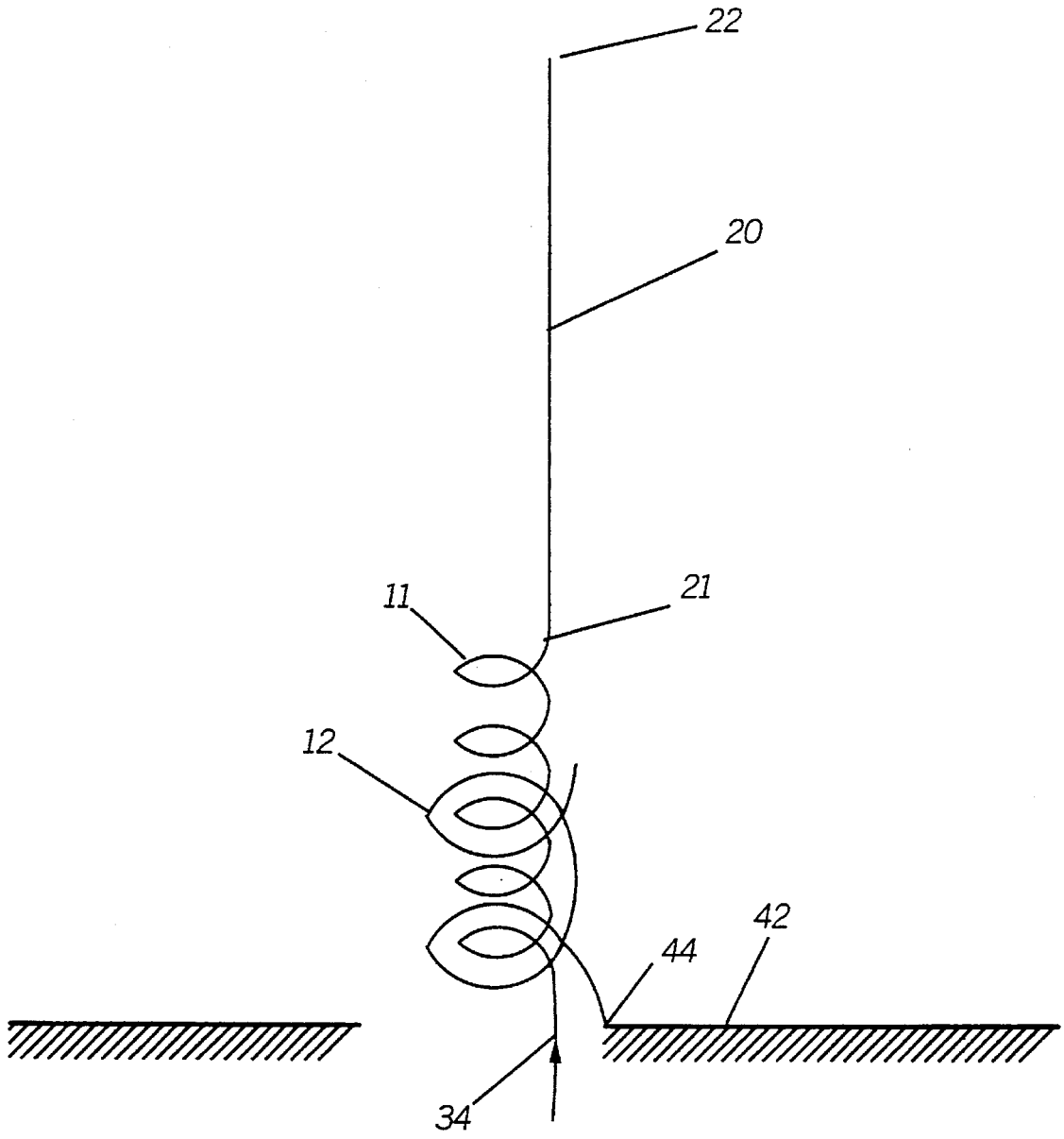
FIG. 4 is a simplified representation of the antenna of FIG.

The first end 21 is closest to an aperture 70 in the ground plane 42 for providing a feed port, while the second end 22 remains an open circuit and free from electrical connections. The normally internal feed port connections are shown outside of the connector 60 for clearer illustration only. FIG. 4 shows a simplified electrical representation of the feed port at the bottom of the transformer 10.

A radio frequency (RF) source, which may comprise an RF amplifier from a transceiver 30 or other communication device, generally matched to 50 ohms, provides a radio frequency (RF) signal 32 to the dipole radiator 20. In order to efficiently excite the dipole 20, having high impedance at either ends 21 and 22, from the source (30) of low impedance (50 ohms), an effective impedance match from the source to the radiator is needed.

For proper matching and broadbanding, the double resonant transformer 10 is formed from two conductive inner and outer elements, concentrically assembled and separated by a spacer 14, as seen in FIG. 2. The two conductive elements are preferably cylindrically configured, such as sleeves or helical coils 11 and 12. For practical implementations, the material of the helixes 11 and 12 is preferably made from standard AWG15 copper clad steel, commonly called music wire having a wire diameter (W) of 1.45 mm. Because the helixes 11 and 12 are in the form of helical coils, their physical lengths (L) are made substantially shorter than their natural resonant dimensions (λ/4).

To excite the dipole 20 which radiates (transmits) the RF signal 32, one end of the first helix 11, is coupled to the first end 21 of the dipole 20 while the other end is connected to the transceiver 30 via a signal feed portion 34 of the feed port. Conversely, to receive, an information signal is fed from the dipole 20 to the first helix 11 which provides the received signal to the transceiver 30 (or optionally a receiver) for further processing.

The dipole ends 21 and 22 may be points or have minimal extended vertical lengths for facilitating connections. However, the first helix 11 need not physically contact the dipole 20, at its first end 21, but positioned sufficiently close such that RF energy is electromagnetically or capacitively coupled to the dipole 20 from the helix feed 11.

For achieving a compromise between a suitable match or impedance transformation and a broader bandwidth, the first helix 11 has a first electrical length of approximately ¼ wavelength λ1 for resonating, by itself, at a first frequency or resonance f1 lower than the operating frequency fo. This quarter wavelength $\lambda_1/4$ is designed to be longer than the quarter wavelength $\lambda_0/4$, at the operating frequency $f_o$, to obtain a lower resonance f1 for assistance in broadbanding the operating bandwidth.

For broadbanding the end fed dipole 20, the second helix 12 is concentrically assembled and wound for tight coupling with a portion of the first helix 11. One end of the second helix 12 is shorted to a ground portion 44 of the feed port which is connected to the ground plane 42. The other end of the second helix 12 is open and free from electrical connections.

In order to minimize the radiation by the transformer 10, the physical length of each component of the transformer is made substantially shorter than its natural resonant dimension by helically coiling a wire in the form of helixes 11 and 12. The electrical length $\lambda_2/4$ of the second helix 12, is made substantially shorter than the electrical length $\lambda_1/4$ of the first helix 11, approximately by a factor of 2, and much, much shorter than the $\lambda_o/4$ of the radiator 20 for providing a second resonance f2, higher than fo or f1. However, the electrical length is made sufficiently long enough to accomplish broadbanding by creating the second resonance close enough to the first resonance, such that a broader bandwidth with double peaks occur (when tightly coupled with the first helix 11), instead of two disconnected resonant peaks. Hence, the two helixes 11 and 12 form two shortened monopoles, each with an electrical length of approximately one quarter of a wavelength $\lambda_1/4$ and $\lambda_2/4$ over the counterpoise (or ground plane 42) for radiating by themselves at two different resonant frequencies f1 and f2.

Concentrically assembled, between the first and second conductive helixes 11 and 12, is the spacer 14, in the form of a cylindrical sleeve for maintaining concentricity and having a thickness and a dielectric constant, for electrically insulating the first and second conductive helixes 11 and 12. Preferably, the dielectric material of the spacer 14 is Teflon™. Optionally, the inner and outer surfaces of the sleeve 14 may be threaded to fit the first and second or inner and outer helixes 11 and 12.

The spacer 14 is sufficiently dimensioned, with the thickness being thin enough, at that dielectric constant, and with the first and second electrical lengths, pitches, and diameters of the first and second helixes 11 and 12, such that the outer helix 12 is tightly coupled to the inner helix 11. The tight coupling is necessary to efficiently broaden the frequency response of the impedance transformer 10, for matching the ½ wavelength radiator, but minimizing radiation within, yet maximizing phase delays, in the double resonant transformer 10. In other words, the lengths, pitches, and diameters of the helixes 11 and 12 and spacer 14 are designed for double resonance, minimal radiation, and proper phase delays.

It is noted that when the resonant frequency of the shortened monopoles 11 and 12 or dipole element 20 is discussed, we are referring to the resonant frequency of each element by itself in free space. That is, such resonance is determined by measuring the resonant frequency of the element prior to coupling to the other elements.

After tightly coupling the outer helix 12 to the inner helix 11 in the region of the feedpoint (21), two different frequencies, shifted closer to $f_o$, than f1 and f2 were to $f_o$, result from the coupled structure. One resultant frequency, slightly shifted lower from f2, but is still higher than the resonant frequency f0 of the dipole radiating element 20 while the second resultant frequency, slightly shifted higher from f1, is still lower than the resonant frequency $f_o$. Hence, if the resonant frequency of the inner helix ($f_1$) is less than that of the outer helix (f2), then an increased bandwidth results. Since it is well-known that wavelength varies inversely with frequency, the higher resultant frequency equates to a shorter wavelength. In effect, the length of the monopole 11 has been reduced on the coupled structure to result in an increase or shift in resonant frequency f1. On the other hand, the length of the shortened monopole 12 is effectively increased for the tightly coupled structure to result in a second resonant frequency shifted lowered than the resonant frequency f2 of the monopole 12 alone.

In order to achieve an antenna with the desired resonant center operating frequency $f_o$ and radiation bandwidth, the proper $f_o$, f1, f2 (frequency determined by length, etc.), and spacing, or coupling, between the two helixes 11 and 12 need to be chosen. This magnitude of coupling between the first helix 11 and the second helix 12 (if the second helix 12 is touching the spacer 14) is a function of the thickness, length, and dielectric constant of the spacer 14 and the pitch, lengths, and diameters of the helixes 11 and 12.

The dimensions of the antenna will, of course, vary depending upon the operating frequency of interest in any particular implementation. However, for the single VHF band mobile radio antenna, built in accordance with the teachings of FIGS. 1 and 2, approximate dimensions are listed in Table 1 for an operating frequency of interest in the approximately middle of the VHF band.

TABLE 1

| Dimension | Helix 11 | Helix 12 | Spacer 14 |
|---|---|---|---|
| body length (L) | 89 mm | 53 mm | 89 mm |
| top end length (TE) | 2 mm | | |
| bottom end length (BE) | 1.5 mm | 1.5 mm | |
| thickness (T) | | | 4.7 mm |
| outside diameter (D) | 12.2 mm | 25 mm | 21.6 mm |
| pitch (P) | 3.54 mm | 9.78 mm | |
| number of turns | 25⅛ | 5⁵⁄₁₂ | |

For the single UHF band mobile radio antenna, built in accordance with the teachings of FIG. 3, approximate dimensions are listed in Table 2 for an operating frequency of interest in the approximately middle of the UHF band.

TABLE 2

| Dimension | Helix 11 | Helix 12 | Spacer 14 |
|---|---|---|---|
| body length (L) | 45 mm | 30 mm | 30 mm |
| bottom end length (BE) | | 4 mm | |
| thickness (T) | | | 3.4 mm |
| wire diameter (W) | 1.53 mm | 1.53 mm | |
| outside diameter (D) | 13.77 mm | 24 mm | 21.1 mm |
| pitch (P) | 11.25 mm | 19.2 mm | |
| number of turns | 4 | 1⁹⁄₁₆ | |

The spacing desired between the two helixes 11 and 12 is determined by the difference in diameters between them.

The ratio of the second helix's diameter over the first helix's diameter is not designed to be the same as the ratio of the diameter of the outer ground conductor 51 of a transmission feed line 50, for providing the RF signal 32, over the diameter of the inner conductor 52 of the transmission line 50. With this transmission line 50 terminated by a standard small SMA 50 ohm coaxial connector 60, the feedpoint at the feed port, is extended up the transformer 10 to the dipole end 21, even though the transmission line impedance would be different from the transformer's impedance (due to the differences in diameter ratios between the two) because the transformer 10 is at ¼ wavelength. Thus, on transmission, the antenna accepts the energy from the guided wave of the transmission line and radiates it into space. Conversely, on reception, the antenna gathers energy from an incident wave and couples it down the transmission line.

As a result of adding a shorter outer helix around an antenna formed by a dipole fed by a quarter wavelength helix feed, the original antenna's bandwidth is increased without compromising its radiation performance. Of course, this broadbanding of the end fed dipole antenna with a double resonant transformer may be applied to other frequencies and bands to minimize band-splits.

What is claimed is:

1. A broadband antenna, comprising:

a feed port including a signal feed portion and a ground portion and having a low impedance;

an approximately ½ wavelength radiator having opposed high impedance ends;

fixed double resonant broadband transforming means for transforming said low impedance to said high impedance over a wide range of frequencies without tuning, said transforming means coupled between said feed port and said approximately ½ wavelength radiator, the broadband transforming means including;

a first conductive means for resonating at a first frequency, said first conductive means having first and second ends, said first end connected to said signal feed portion of said feed port and said second end coupled to said first end of said ½ wavelength radiator; and a second conductive means shorter in length than the first conductive means for resonating at a second frequency, said second conductive means having first and second ends, said second conductive means concentrically positioned around a portion of said first conductive means, said first end shorted to said ground portion of said feed port and said second end being open and free from electrical connections.

2. The antenna of claim 1, wherein said double resonant transforming means further comprises spacer means, concentrically positioned between said first and second conductive means, for electrically insulating said first and second conductive means, said spacer means being sufficiently thin such that said first conductive means is tightly coupled to said second conductive means so as to broadband the frequency response exhibited by said ½ wavelength radiator.

3. The antenna of claim 1, wherein said ½ wavelength radiator comprises an end-fed dipole.

4. An antenna assembly, comprising:

a feed port including a signal feed portion and a ground portion, said ground portion connected to a ground plane;

an approximately ½ wavelength dipole radiator having first and second high impedance ends;

a first fixed conductive helix having first and second ends, a first diameter, and exhibiting a first pitch and a first electrical length, said first end coupled to said signal feed portion of said feed port for receiving a radio frequency signal and said second end connected to said first high impedance end of said ½ wavelength radiator;

a second fixed conductive helix shorter in length than the first fixed conductive helix and having first and second ends, a second diameter, and exhibiting a second pitch and a second electrical length, said second conductive helix concentrically wound around a portion of said first conductive helix to form a fixed broadband double resonant transformer which accomplishes broadband performance without tuning, said first end shorted to said ground portion of said feed port and said second end being open and free from electrical connections; and spacer means having a thickness and a dielectric constant, concentrically situated between said first and second conductive helixes, for electrically insulating said first and second conductive helixes, said spacer means being sufficiently dimensioned, in said thickness being thin enough, at said dielectric constant, and with said first and second electrical lengths, pitches, and diameters of said first and second helixes, such that said first helix is tightly coupled to said second helix, so as to efficiently broaden the frequency response exhibited by said ½ wavelength radiator by minimizing radiation and maximizing phase delays in said double resonant transformer.

5. A communication device, comprising:

a transceiver for providing a radio frequency signal; and an antenna comprising:

a feed port including a signal feed portion and a ground portion;

a dipole radiator having an electrical length approximately between ½ wavelength $\lambda_o$ and ⅝ wavelength $\lambda_o$ and having first and second high impedance ends;

a first fixed conductive helix having first and second ends, a first diameter, and exhibiting a first pitch and a first electrical length of approximately ¼ wavelength $\lambda_1$, said first end coupled to said signal feed portion of said feed port for receiving said radio frequency signal and said second end connected to said first high impedance end of said radiator; and a second fixed conductive helix shorter in length than the first fixed conductive helix and having first and second ends, a second diameter, and exhibiting a second pitch and a second electrical length of approximately ¼ wavelength $\lambda_2$, said second conductive helix concentrically wound, around a portion of said first conductive helix to form a fixed and broadband double resonant transformer which provides broadband coupling without tuning, said first end shorted to said ground portion of said feed port and said second end being open and free from electrical connections.

6. The communication device of claim 5, further comprising:

a transmission feed line having inner and outer conductors for coupling said transceiver to said antenna; and a coaxial connector terminating said transmission feed line at the upper terminus of the inner and outer conductors, wherein the feed port is located at the upper terminus of said coaxial connector.

7. The communication device of claim 5, wherein said second end of said ½ wavelength radiator being open and free from electrical connections.

8. The communication device of claim 5, wherein said radiator comprises a plurality of dipole elements separated by an 180 degree phase shifter.

9. The communication device of claim 5, wherein said second electrical length $\lambda_2/4$ of said second helix is substantially shorter than said first electrical length $\lambda_1/4$ of said first helix by approximately a factor of 2.

10. The communication device of claim 5, wherein said first electrical length $\lambda_1/4$ of said first helix is longer than a $\lambda_0/4$ of said radiator.

* * * * *